US007511434B2

(12) United States Patent
Shin

(10) Patent No.: US 7,511,434 B2
(45) **Date of Patent: *Mar. 31, 2009**

(54) LAMP DRIVING APPARATUS, LIQUID CRYSTAL DISPLAY COMPRISING THE SAME, AND DRIVING METHOD THEREOF

(75) Inventor: Chung-hyuk Shin, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 57 days.

This patent is subject to a terminal disclaimer.

(21) Appl. No.: 11/325,034

(22) Filed: Jan. 3, 2006

(65) Prior Publication Data

US 2006/0145635 A1 Jul. 6, 2006

(30) Foreign Application Priority Data

Jan. 3, 2005 (KR) ..... 10-2005-0000134

(51) Int. Cl.
*G05F 1/00* (2006.01)

(52) U.S. Cl. ..... 315/291; 315/224; 315/307; 345/102

(58) Field of Classification Search ..... 315/291, 315/224, 225, 307, 246, DIG. 2, DIG. 5, 315/DIG. 7; 345/87, 102
See application file for complete search history.

(56) References Cited

U.S. PATENT DOCUMENTS

| | | | | |
|---|---|---|---|---|
| 6,150,772 | A * | 11/2000 | Crane | 315/291 |
| 6,198,234 | B1 * | 3/2001 | Henry | 315/291 |
| 2004/0252481 | A1 * | 12/2004 | Moon | 362/31 |
| 2005/0168172 | A1 * | 8/2005 | Kim | 315/291 |
| 2005/0194916 | A1 * | 9/2005 | Okawa et al. | 315/291 |

* cited by examiner

*Primary Examiner*—Douglas W Owens
*Assistant Examiner*—Ephrem Alemu
(74) *Attorney, Agent, or Firm*—Cantor Colburn LLP

(57) ABSTRACT

A lamp driving apparatus includes a lamp driving power system providing a driving power to a lamp, a sensor detecting whether the lamp is turned on, and a controller controlling the lamp driving power system to provide an initial driving power to the lamp to turn on the lamp, and to provide an excess driving power to the lamp if the sensor detects that the lamp is not turned on, the excess driving power having a higher voltage level than the initial driving power. A liquid crystal display includes the lamp driving apparatus and a driving method thereof includes a lamp that is stably driven at an initial stage of operation.

31 Claims, 5 Drawing Sheets

LAMP DRIVING APPARATUS, LIQUID CRYSTAL DISPLAY COMPRISING THE SAME, AND DRIVING METHOD THEREOF

This application claims priority to Korean Patent Application No. 2005-0000134, filed on Jan. 3, 2005 and all the benefits accruing therefrom under 35 U.S.C. §119, and the contents of which in its entirety are herein incorporated by reference.

BACKGROUND OF THE INVENTION

1. Field of the Invention

The present invention relates to a lamp driving apparatus, a liquid crystal display ("LCD") having the same and a driving method thereof, and more particularly, to a lamp driving apparatus, an LCD having the same and a driving method thereof which includes an inverter for driving a lamp.

2. Description of the Related Art

Generally, a liquid crystal display ("LCD") has a light mass, thin depth, and low power consumption. Thus, LCDs are often used for office automatic appliances, audio/video appliances etc. Because the LCD is not a self-emitting display apparatus, the LCD requires a light source such as a backlight unit. The LCD displays an image on a liquid crystal panel by using light emitted from the backlight unit.

Conventionally, a cold cathode fluorescent lamp ("CCFL") is used as the light source of the backlight unit. The CCFL is valuable for generating low heat, high brightness, long life span, and full color. However, when high voltage is applied to a surface of a cathode of the CCFL, a plurality of electrons are emitted outwardly, so that the CCFL needs the high voltage to drive itself.

Generally, an inverter having a transformer generates the high voltage. A level of initial driving power is sensitively influenced by circumstantial factors of the lamp. The initial driving power for driving the CCFL needs the higher level of power at low temperatures than at high temperatures and in a state of absence of light than in a state of existence of light. If the initial driving power of the required voltage level is not provided to the lamp, a driving power of the lamp is cut off and then the lamp may not be driven after a predetermined time.

Thus, when the lamp is in environments of absence of light and low temperature, it takes a longer time for driving the lamp than in environments having an existence of light and a higher temperature. Moreover, the lamp has difficulty in adequately driving due to the high initial driving voltage.

BRIEF SUMMARY OF THE INVENTION

Accordingly, it is an aspect of the present invention to provide a lamp driving apparatus, a liquid crystal display ("LCD") having the same and a driving method thereof including a lamp that is stably driven at an initial stage of operation.

Additional aspects and/or advantages of the present invention will be set forth in part in the description which follows and, in part, will be obvious from the description, or may be learned by practice of the present invention.

The foregoing and/or other aspects of the present invention are also achieved by providing a lamp driving apparatus including a lamp driving power system providing a driving power to a lamp, a sensor detecting whether the lamp is turned on, and a controller controlling the lamp driving power system to provide an initial driving power to the lamp to turn on the lamp, and to provide an excess driving power to the lamp if the sensor detects that the lamp is not turned on, the excess driving power having a higher voltage level than the initial driving power.

According to an aspect of the present invention, if the sensor detects that the lamp is turned on, the controller controls the lamp driving power system to provide a normal driving power to the lamp, the normal driving power having a lower voltage level than a driving power turning on the lamp.

According to an aspect of the present invention, the lamp driving power system includes an inverter converting an input direct current power into an alternating current power, a high voltage generating part raising a voltage level of power from the inverter and outputting a raised voltage level of power to the lamp, and an auxiliary circuit part adjusting a voltage level of a feedback signal output from the high voltage generating part and fed back to the controller.

According to an aspect of the present invention, the auxiliary circuit includes a plurality of impedance parts coupled in parallel to an output terminal of the feedback signal, and a plurality of switching elements coupled to the impedance parts, respectively.

According to an aspect of the present invention, the controller controls the switching elements grounding at least one of the impedance parts if the sensor detects that the lamp is not turned on.

The foregoing and/or other aspects of the present invention are also achieved by providing a liquid crystal display including a lamp providing light to a liquid crystal panel, a lamp driving power system providing a driving power to the lamp, a sensor detecting whether the lamp is turned on, and a controller controlling the lamp driving power system to provide an initial driving power to the lamp to turn on the lamp, and to provide an excess driving power to the lamp if the sensor detects that the lamp is not turned on, the excess driving power having a higher voltage level than the initial driving power.

The foregoing and/or other aspects of the present invention are also achieved by providing a method of driving a lamp including providing an initial driving power to the lamp, detecting whether the lamp is turned on, and if detected that the lamp is not turned on, providing an excess driving power to the lamp, the excess driving power having a higher voltage level than the initial driving power.

According to an aspect of the present invention, the method further includes, if detected that the lamp is turned on, providing a normal driving power, the normal driving power having a lower voltage level than a driving power turning on the lamp.

According to an aspect of the present invention, providing the excess driving power includes forming a plurality of impedance parts coupled in parallel to an output terminal of a feedback signal, and adjusting a total impedance of the impedance parts to increase.

BRIEF DESCRIPTION OF THE DRAWINGS

The above and/or other aspects and advantages of the present invention will become apparent and more readily appreciated from the following description of the embodiments, taken in conjunction with the accompanying drawings in which.

DETAILED DESCRIPTION OF THE INVENTION

Figure 1:
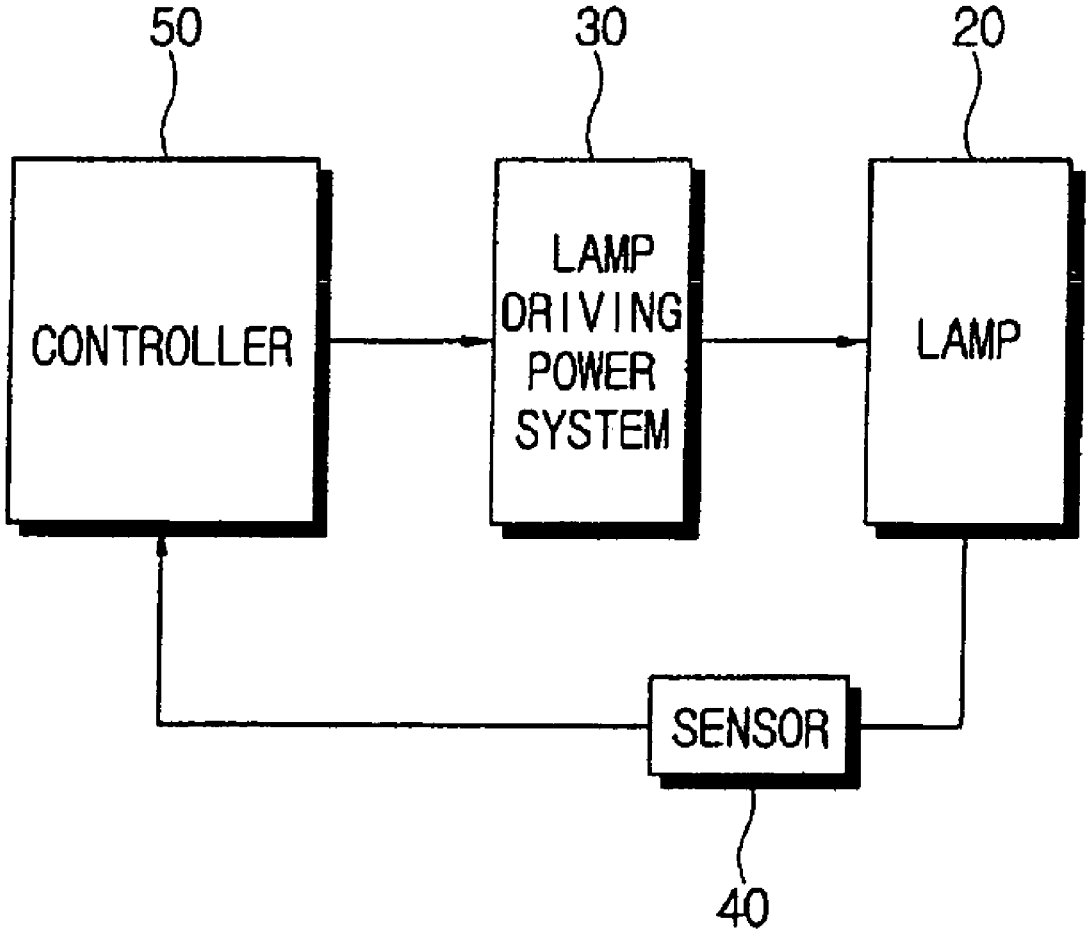
FIG. 1 is a control block diagram of an exemplary embodiment of a lamp driving apparatus according to the present invention.

Reference will now be made in detail to the embodiments of the present invention, examples of which are illustrated in the accompanying drawings, wherein like reference numerals refer to like elements throughout.

FIG. 1 is a control block diagram illustrating an exemplary embodiment of a lamp driving apparatus according to the present invention. As shown in FIG. 1, the lamp driving apparatus includes a lamp 20, lamp driving power system 30, a sensor 40, and a controller 50.

In an exemplary embodiment, the lamp 20 is provided as a CCFL that provides light to a liquid crystal panel (not shown) Because the CCFL needs an initial high voltage, such as more than twice as much as a normal driving voltage, it is important to make the lamp driving power system 30 output the initial driving power of the adequate voltage level when the lamp driving power system is designed. The lamp 20 may be provided as an external electrode fluorescent lamp ("EEFL") as well as the CCFL. Other lamps and light sources would also be within the scope of these embodiments.

The lamp driving power system 30, such as a power regulator, provides the driving power to the lamp 20 by raising the voltage level of the input power. The initial driving power refers to the driving power initially applied to the lamp 20 to turn on the lamp 20, the normal driving power refers to the driving power applied to the lamp 20 after the lamp 20 has been turned on, and an excess driving power refers to the driving power applied to the lamp 20 unless the lamp 20 has already been turned on by the initial driving power. As described above, the initial driving power should have the high voltage level more than about twice as much the normal driving power, which is caused by a feature of the CCFL. The excess driving power has a higher voltage level than the predetermined initial driving power. The controller 50 determines the voltage level of the excess driving power. Because of the circumstantial factors that affect the level of initial driving power required for the lamp 20, as will be further described below, the controller 50 iteratively determines the voltage level of an excess driving power until the lamp 20 is finally turned on.

The sensor 40 detects whether the lamp 20 is turned on or not by means of the initial driving power supplied from the lamp driving power system 30. The sensor 40 may detect an operation of the lamp 20 by measuring a voltage or a current of the lamp 20, and by using a separate sensor. In any case, the sensor 40 detects if the lamp 20 has been turned on, and, if the sensor 40 does detect that the lamp 20 has been turned on, such information would be passed to the controller 50 from the sensor 40.

The controller 50 controls the operation of the lamp driving power system 30. The controller 50 applies the input power to the lamp driving power system 30, and then the input power is raised by a predetermined amount in the lamp driving power system 30 and the raised power is output into the lamp 20. If the sensor 40 does not detect that the lamp is turned on even after the initial driving power has been provided to the lamp 20, the controller 50 controls the lamp driving power system 30 to provide the excess driving power, having a higher voltage level than the initial driving power, to the lamp 20. Within a conventional LCD, unless the lamp 20 stays on for a predetermined period, the driving power to the lamp 20 is cut off. Accordingly, even when the initial driving power is provided to the lamp 20, the lamp 20 may not be turned on. However, in the exemplary embodiments of the LCD according to the present invention, the sensor 40 detects that the lamp 20 is turned on or off after the initial driving power is provided to the lamp 20. Then, if the lamp 20 is determined by the sensor 40 as not yet turned on, the excess driving power is provided to the lamp 20 at predetermined intervals based on the detection result of the sensor 40.

To provide the excess driving power to the lamp 20, a circuit within the lamp driving power system 30 generating the driving power may be changed, or the lamp driving apparatus may include a separate excess power generation part generating the driving power of the higher voltage level than voltage level of the predetermined initial driving power.

A time interval and a voltage level for supplying the excess driving power, which may be preset in the controller 50, may be designed by considering a feature of the lamp 20.

If the sensor 40 detects that the lamp 20 is turned on, then the controller 50 controls the lamp driving power system 30 to provide the normal driving power having a lower voltage level than the initial driving power of the lamp 20.

Figure 2:
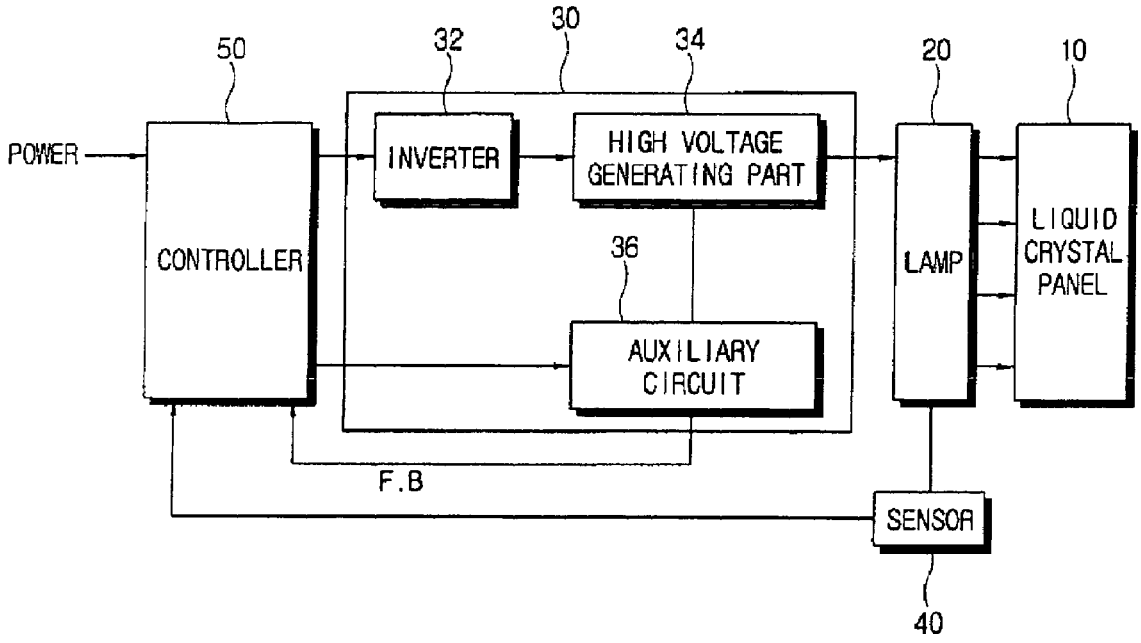
FIG. 2 is a control block diagram of an exemplary embodiment of a liquid crystal display ("LCD") according to the present invention.

FIG. 2 is a control block diagram illustrating an exemplary embodiment of an LCD according to the present invention. As shown in FIG. 2, the LCD includes a liquid crystal panel 10, the lamp 20, the lamp driving power system 30, the sensor 40, and the controller 50.

The LCD includes the liquid crystal panel 10. Although not illustrated, the liquid crystal panel 10 includes a thin film transistor ("TFT") substrate, a color filter substrate, and a liquid crystal layer sandwiched between the TFT substrate and the color filter substrate. Since the liquid crystal panel 10 cannot emit light itself, a backlight unit may be located behind the TFT substrate to emit light. The transmittance of light from the backlight unit depends on the alignment of liquid crystal molecules within the liquid crystal layer. In addition, the LCD may further include a drive integrated circuit, a data driver, and a gate driver to drive a pixel, wherein the data driver and the gate driver receive a driving signal from the drive integrated circuit and then apply a driving voltage to a data line and a gate line, respectively, within a display area of the liquid crystal panel 10.

A method of supplying an image data signal to every pixel of the LCD is as follows.

First, a timing controller receives the image data signal from an image data source (for example, a computer or a television, etc.) and then outputs the driving signal to the gate driver and outputs the image data signal to the data driver according to predetermined intervals. The gate driver sequentially turns on switching elements connected to the gate line by applying a gate-on signal as a scanning signal to the gate line. Simultaneously, the data driver supplies a gray scale voltage of the image data signal to a pixel row corresponding to the gate line to the respective data lines. Then, the image data signal supplied to the data line is delivered through the switching elements turned on to each pixel. The gate-on signal is sequentially provided to every gate line and the data signal is provided to every pixel row, thereby displaying one frame picture.

As previously described, the liquid crystal panel 10 cannot emit light itself, and therefore requires a backlight unit such as a backlight unit including the lamp 20.

The lamp driving power system 30 includes an inverter 32, a high voltage generating part 34, and an auxiliary circuit 36. The lamp driving power system 30 generates the driving power for driving the lamp 20 in response to a control signal from the controller 50.

The inverter 32 converts a direct current power, input to the lamp driving power system 30 from the controller 50, into an alternating current power. The inverter 32 thus outputs the alternating current power towards the high voltage generating part 34. The inverter 32 includes a plurality of transistors (not shown). The transistors convert the direct current power, which is input from the controller 50, into an alternating current pulse signal and transmits the alternating current pulse signal to the high voltage generating part 34.

The high voltage generating part 34 raises the voltage level of the driving power input from the inverter 32 (the alternating current power) and outputs the driving power with the raised voltage level to the lamp 20. The high voltage generating part 34 includes a transformer having a primary coil and a secondary coil. The high voltage generating part 34 boosts the input power from the inverter 32 according to a winding rate between the primary coil and the secondary coil.

The auxiliary circuit 36 adjusts the voltage level of a feedback signal output from the high voltage generating part 34 and feeds back the adjusted feedback signal ("FB") to the controller 50. The auxiliary circuit 36 includes an impedance part generating a gap of the voltage level between a predetermined standard voltage and the feedback signal, and a switching part, as will be further described below with respect to FIG. 3. If the gap of the voltage level between the standard voltage and the feedback signal is generated, the voltage level of the driving power is raised in order to compensate the voltage level of the feedback signal.

Any design of the auxiliary circuit 36 that alters the voltage level of the feedback signal so that the voltage level of the driving power from the high voltage generating part 34 is raised would be within the scope of these embodiments. Alternatively, the auxiliary circuit 36 may be an independent circuit that does not adjust the feedback signal, but instead generates the excess driving power.

The controller 50, as previously described with respect to FIG. 1, additionally controls the auxiliary circuit 36. If the sensor 40 detects that the lamp 20 is not turned on, the controller 50 supplies a power to the auxiliary circuit 36 and controls the switching part of the auxiliary circuit 36 so that the voltage level of the feedback signal is adjusted, as will be further described below with respect to FIG. 3.

Figure 3:
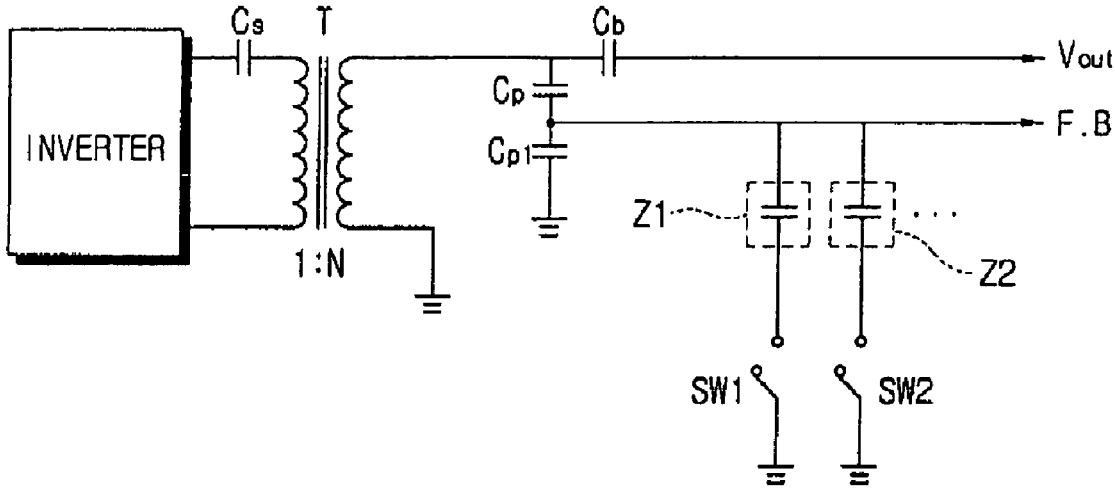
FIG. 3 is a circuit diagram of an exemplary embodiment of an auxiliary circuit of the LCD according to the present invention.

FIG. 3 is a circuit diagram illustrating an exemplary embodiment of the auxiliary circuit of the LCD according to the present invention. FIG. 3 shows the inverter 32 outputting the alternating current pulse, the transformer T as the high voltage generating part 34, the driving power (Vout) output from the transformer T to the lamp 20, the feedback signal ("F.B") fed back to the controller 50 from the auxiliary circuit 36, and the auxiliary circuit 36 having impedance parts (e.g., $Z_1$, $Z_2$, . . . ).

The transformer T outputs the driving power Vout for driving the lamp 20 according to the winding rate between the primary coil and the secondary coil within the transformer T. A capacitor Cs may be positioned between the inverter 32 and the transformer T. The inverter 32 supplies the alternating current pulse to the primary coil of the transformer T through the transistors and the supplied alternating current pulse is induced to the secondary coil of the transformer T. The alternating current pulse induced to the secondary coil is boosted and supplied to a high voltage electrode of the lamp 20 through a first terminal of the secondary coil. A capacitor Cb may be provided between the first terminal of the secondary coil of the transformer T and the high voltage electrode of the lamp 20. A second terminal of the secondary coil is grounded as shown. The feedback signal F.B is derived from the driving power Vout output from the first terminal of the secondary coil of the transformer T by dividing the voltage level of the driving power Vout. The auxiliary circuit 36 includes a plurality of the impedance parts, Z1, Z2, . . . , that are coupled in parallel to the output terminal of the feedback signal and switching elements, SW1, SW2, . . . , coupled to the impedance parts Z1, Z2, . . . , respectively. As shown, an output node of the feedback signal is coupled with a capacitor Cp1 grounded. Another capacitor Cp may be provided between the output node of the feedback signal and to the line between the transformer T and capacitor Cb.

The controller 50 controls at least one of the impedance parts, Z1, Z2, . . . , to be grounded if the sensor 40 does not detect that the lamp 20 is turned on. If the lamp 20 is not turned on by the initial driving power, one of the switching elements (e.g., SW1) is switched on and the whole impedance of the output terminal of the feedback signal F.B decreases. Therefore, the gap of the voltage level between the feedback signal F.B and the predetermined standard voltage occurs and the voltage level of the driving power is raised so as to compensate for this gap. If the lamp 20 is not driven regardless of switching the switching element (SW1), the controller 50 switches another switching element (e.g. SW2) on so as to further decrease the whole impedance, and, if only two impedance parts and two switching elements are respectively employed, then the whole impedance may be deceased when both switching elements SW1 and SW2 are switched on. A plurality of the impedance parts, Z1, Z2, . . . , may be grounded in the above described method. Thus, the more impedance parts coupled in parallel, the more the voltage level of the driving power is increased higher and higher. Consequently, the excess driving power is output into the lamp 20. The term and the order of switching the switching elements SW1, SW2, . . . , or a dimension of the impedance may be variously designed.

Figure 4:
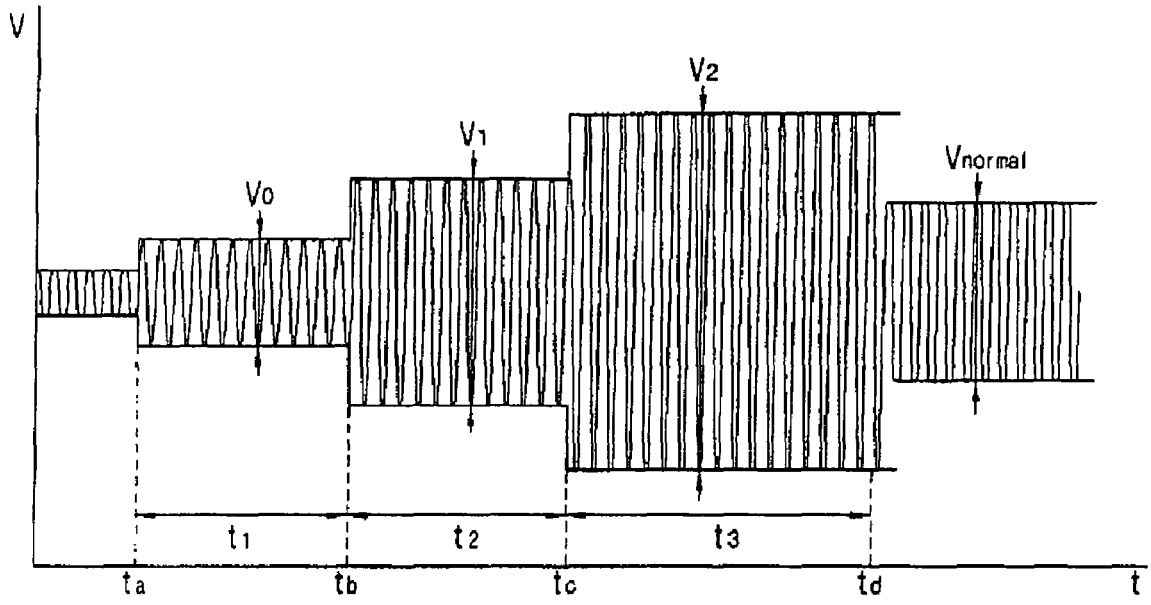
FIG. 4 is a graph illustrating an exemplary voltage level of a driving power of a lamp according to the present invention.

FIG. 4 is a graph illustrating an exemplary embodiment of a voltage level of the driving power of the lamp 20 generated according to the present invention, and shows the result of an exemplary operation of the two switching elements shown in FIG. 3.

If the lamp 20 is not turned on after the initial driving power $V_0$ is supplied for the predetermined term $t_1$, the controller 50 controls the switching element SW1 to be grounded to one of the impedance parts, e.g. Z1. Due to the operation of the switching element SW1, the first excess driving power $V_1$ is supplied to the lamp 20, where the first excess driving power $V_1$ has a greater voltage level than the initial driving power $V_0$. Despite the increased voltage level of the first excess driving power $V_1$, if the lamp 20 is still not turned on during the term $t_2$, then the second excess driving power $V_2$ is supplied to the lamp 20. If the lamp 20 is not turned on by only the initial driving power $V_0$ because of a circumstantial condition, such as described above, the impedance parts are gradually grounded. Therefore, the voltage level of the driving power for compensating the feedback signal F.B increases step by step. By example only, if the lamp 20 is turned on after the second excess driving power $V_2$ is provided to the lamp 20, then the controller 50 causes the lamp driving power system 30 to provide the normal driving power Vnormal with the lamp 20. The voltage level of the normal driving power Vnormal is illustrated as about half of the second excess driving power $V_2$. The voltage level of the normal driving power Vnormal is less than the voltage level or the driving power required to turn on the lamp 20. It should be noted that an output alternating current pulse prior to the initial driving power $V_0$ may be contributed to noise.

Figure 5:
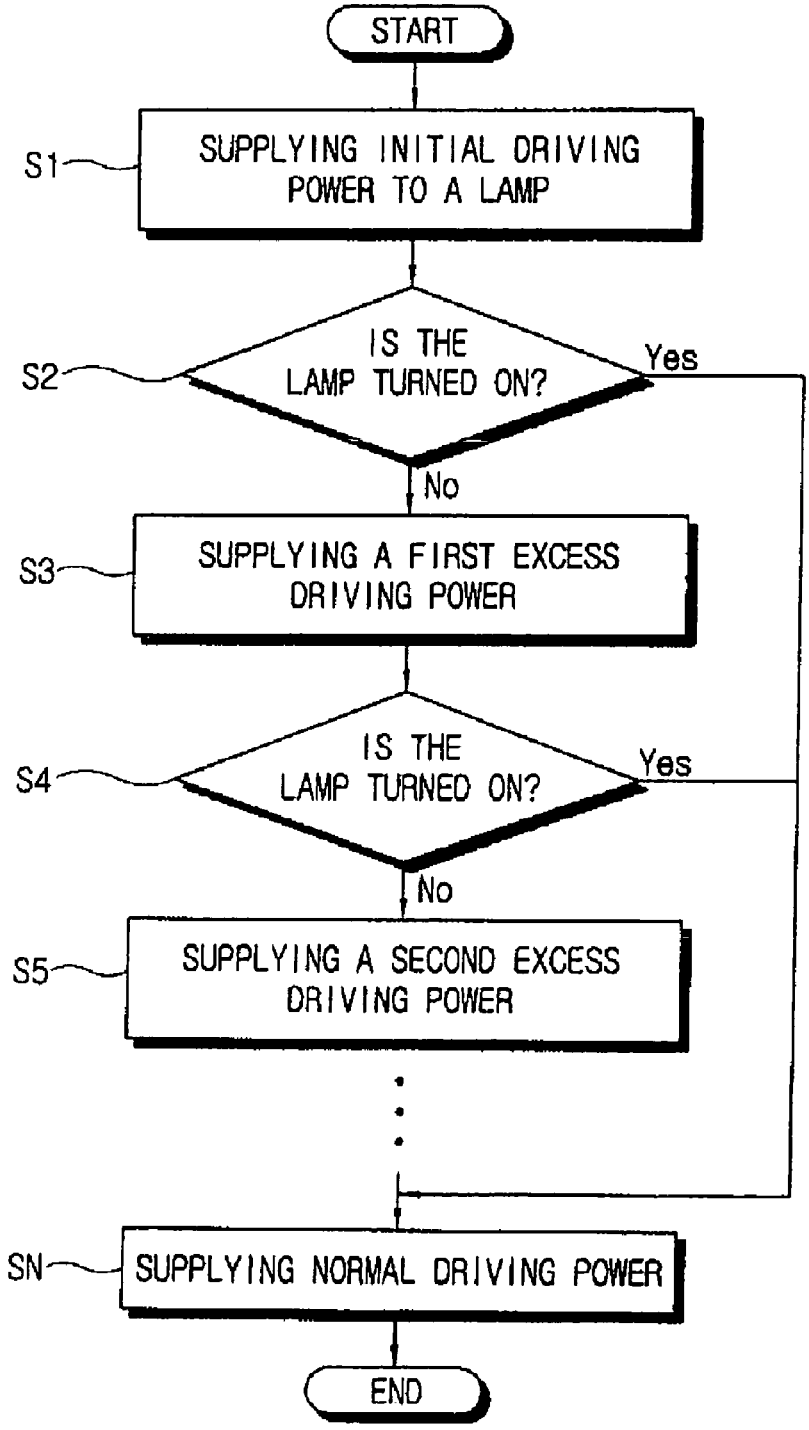
FIG. 5 is a control flow chart for the exemplary embodiment of the LCD according to the present invention.

FIG. 5 is a control flow chart describing the exemplary embodiment of the LCD according to the present invention.

The lamp driving power system 30 provides the initial driving power $V_0$ to the lamp 20 at operation S1 and then the sensor 40 detects whether the lamp 20 is turned on at operation S2. If the lamp 20 is turned on as a result of the initial driving power $V_0$, then the voltage level of the normal driving power Vnormal would be lower than the initial driving power $V_0$ and would be provided to the lamp 20 by the controller 50 at operation SN. However, if the lamp 20 is not turned on as detected in step S2, then the first excess driving power $V_1$ is provided to the lamp 20 at operation S3, the sensor 40 again detects whether the lamp 20 is turned on at operation S4. Similarly, the second excess driving power $V_2$ and, if necessary, a third excess driving power $V_3$ are generated and provided to the lamp 20, the sensor 40 detects whether the lamp 20 is turned on or not between each step. If the excess driving power turns on the lamp 20, the normal driving power Vnormal is provided to the lamp 20. The normal driving power Vnormal would have a lower voltage level than a voltage level of the driving power that successfully turned on the lamp 20. Finally, light is emitted to the liquid crystal panel 10 by means of the operation of lamp 20.

Although a few embodiments of the present invention have been shown and described, it will be appreciated by those skilled in the art that changes may be made in these embodiments without departing from the principles and spirit of the invention, the scope of which is defined in the appended claims and their equivalents. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A lamp driving apparatus comprising:

a lamp driving power system providing a driving power to a lamp;

a sensor detecting whether the lamp is turned on; and a controller which controls the lamp driving power system to provide an initial driving power to the lamp to turn on the lamp, and to provide an excess driving power to the lamp if the sensor detects that the lamp is not turned on, the excess driving power having a higher voltage level than the initial driving power;

wherein the controller receives a feedback signal output from the lamp driving power system and fed back to the controller.

2. The lamp driving apparatus according to claim 1, wherein, if the sensor detects that the lamp is not turned on after the initial driving power, the controller controls the lamp driving power system to repeatedly provide the excess driving power to the lamp by increasing a voltage level of a driving power previously applied to the lamp until it is detected that the lamp is turned on.

3. The lamp driving apparatus according to claim 1, wherein the feedback signal is generated in the lamp driving power system.

4. The lamp driving apparatus according to claim 3, wherein the controller decreases a voltage level of the feedback signal if the sensor detects that the lamp is not turned on.

5. The lamp driving apparatus according to claim 4, wherein a voltage level of the driving power is increased when the voltage level of the feedback signal is decreased.

6. The lamp driving apparatus according to claim 1, wherein, if the sensor detects that the lamp is turned on, the controller controls the lamp driving power system to provide a normal driving power to the lamp, the normal driving power having a lower voltage level than a driving power turning on the lamp.

7. The lamp driving apparatus according to claim 1, wherein the lamp driving power system comprises an inverter converting an input direct current power into an alternating current power;

a high voltage generating part raising a voltage level of power from the inverter and outputting a raised voltage level of power to the lamp; and an auxiliary circuit part adjusting a voltage level of a feedback signal output from the high voltage generating part and fed back to the controller.

8. The lamp driving apparatus according to claim 7, wherein the auxiliary circuit comprises a plurality of impedance parts coupled in parallel to an output terminal of the feedback signal; and a plurality of switching elements coupled to the impedance parts, respectively.

9. The lamp driving apparatus according to claim 8, wherein the controller controls the switching elements grounding at least one of the impedance parts if the sensor detects that the lamp is not turned on.

10. The lamp driving apparatus according to claim 8, wherein an impedance part in the plurality of impedance parts comprises a capacitor.

11. The lamp driving apparatus of claim 7, wherein the high voltage generating part includes a transformer having a primary coil and a secondary coil, the transformer boosting an input power according to a winding rate between the primary coil and the secondary coil.

12. The lamp driving apparatus of claim 11, wherein the raised voltage level of power is supplied to the lamp from a first terminal of the secondary coil, and a second terminal of the secondary coil is grounded.

13. The lamp driving apparatus according to claim 1, further comprising a lamp, wherein the lamp comprises at least one of a cold cathode fluorescent lamp or an external electrode fluorescent lamp.

14. The lamp driving apparatus of claim 1, wherein the lamp driving power system is a power regulator.

15. A liquid crystal display comprising:

a lamp providing light to a liquid crystal panel;

a lamp driving power system providing a driving power to the lamp;

a sensor detecting whether the lamp is turned on; and a controller which controls the lamp driving power system to provide an initial driving power to the lamp to turn on the lamp, and to provide an excess driving power to the lamp if the sensor detects that the lamp is not turned on, the excess driving power having a higher voltage level than the initial driving power;

wherein the controller directly receives a feedback signal output from the lamp driving power system and fed back to the controller.

16. The liquid crystal display according to claim 15, wherein, if the sensor detects that the lamp is not turned on after the initial driving power, the controller controls the lamp driving power system to repeatedly provide an excess driving power to the lamp by increasing a voltage level of a driving power previously applied to the lamp until it is detected that the lamp is turned on.

17. The liquid crystal display according to claim 15, wherein the feedback signal is generated in the lamp driving power system.

18. The liquid crystal display according to claim 17, wherein the controller decreases a voltage level of the feedback signal if the sensor detects that the lamp is not turned on.

19. The liquid crystal display according to claim 18, wherein a voltage level of the driving power is increased when the voltage level of the feedback signal is decreased.

20. The liquid crystal display according to claim 15, wherein, if the sensor detects that the lamp is turned on, the controller controls the lamp driving power system to provide a normal driving power to the lamp, the normal driving power having a lower voltage level than a driving power turning on the lamp.

21. The liquid crystal display according to claim 15, wherein the lamp driving power system comprises an inverter converting an input direct current power into an alternating current power;

a high voltage generating part raising a voltage level of power from the inverter and outputting a raised voltage level of power to the lamp; and an auxiliary circuit part adjusting a voltage level of a feedback signal output from the high voltage generating part and fed back to the controller.

22. The liquid crystal display according to claim 21, wherein the auxiliary circuit comprises a plurality of impedance parts coupled in parallel to an output terminal of the feedback signal; and a plurality of switching elements coupled with the impedance parts, respectively.

23. The liquid crystal display according to claim 22, wherein the controller controls the switching elements grounding at least one of the impedance parts if the sensor detects that the lamp is not turned on.

24. The liquid crystal display according to claim 22, wherein an impedance part in the plurality of impedance parts comprises a capacitor.

25. The liquid crystal display apparatus according to claim 15, wherein the lamp comprises at least one of a cold cathode fluorescent lamp or an external electrode fluorescent lamp.

26. A method of driving a lamp comprising:

providing driving powers to the lamp;

detecting whether the lamp is turned on; and if detected that the lamp is not turned on, providing an excess driving power to the lamp, the excess driving power having a higher voltage level than an initial driving power;

wherein the providing the excess driving power includes adjusting a voltage level of a feedback signal derived from the initial driving power and fed back to further provide the driving powers to the lamp.

27. The method of driving a lamp according to claim 26, further comprising:

if detected that the lamp is turned on, providing a normal driving power to the lamp, the normal driving power having a lower voltage level than a driving power turning on the lamp.

28. The method of driving a lamp according to claim 26, wherein the providing the excess driving power includes decreasing a voltage level of a feedback signal derived from the initial driving power.

29. The method of driving a lamp according to claim 26, wherein providing the excess driving power includes repeatedly increasing a voltage level of a driving power previously applied to the lamp until it is detected that the lamp is turned on.

30. The method of driving a lamp according to claim 26, wherein the providing the excess driving power comprises:

forming a plurality of impedance parts coupled in parallel to an output terminal of the feedback signal; and adjusting a total impedance of the impedance parts to increase.

31. The method of driving a lamp according to claim 30, further comprising adjusting a total impedance of the output terminal of the feedback signal to decrease by increasing the total impedance of the impedance parts.

* * * * *